US005234890A

United States Patent [19]

Burberry et al.

[11] Patent Number: 5,234,890

[45] Date of Patent: Aug. 10, 1993

[54] MULTICOLOR DYE-CONTAINING BEADS FOR MULTILAYER DYE-DONOR ELEMENT FOR LASER-INDUCED THERMAL DYE TRANSFER

[75] Inventors: Mitchell S. Burberry, Webster; John M. Noonan, Rochester; Thomas A. Machell, Webster; Danny R. Thompson, Fairport, all of N.Y.

[73] Assignee: Eastman Kodak Company, Rochester, N.Y.

[21] Appl. No.: 992,235

[22] Filed: Dec. 17, 1992

[51] Int. Cl.[5] ..... B41M 5/035; B41M 5/38

[52] U.S. Cl. ..... 503/227; 428/195; 428/212; 428/327; 428/478.2; 428/508; 428/509; 428/510; 428/913; 428/914; 430/200; 430/201; 430/945

[58] Field of Search ..... 8/471; 428/195, 212, 428/323, 327, 478.2, 508-510, 913, 914; 430/200, 201, 945; 503/227

[56] References Cited

U.S. PATENT DOCUMENTS 4,833,060 5/1989 Nair et al. ..... 430/137

FOREIGN PATENT DOCUMENTS

88/07450 10/1988 World Int. Prop. O. ..... 430/138

*Primary Examiner*—B. Hamilton Hess

*Attorney, Agent, or Firm*—Harold E. Cole

[57] ABSTRACT

This invention relates to a multicolor, multilayer dye donor element for laser-induced thermal dye transfer comprising a support having thereon two or more dye layers of different colors on top of each other, each dye layer comprising solid, homogeneous beads which contain an image dye, a binder and a laser light-absorbing material, the beads being dispersed in a vehicle, and the beads of each dye layer being sensitized to a different wavelength.

18 Claims, No Drawings

MULTICOLOR DYE-CONTAINING BEADS FOR MULTILAYER DYE-DONOR ELEMENT FOR LASER-INDUCED THERMAL DYE TRANSFER

This invention relates to the use of certain multicolor dye-containing beads in multilayers of a donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared-absorbing material, such as an infrared-absorbing dye, and one or more image dyes in a binder.

PCT publication WO 88/07450 discloses an inking ribbon for laser thermal dye transfer comprising a support coated with microcapsules containing printing inks and laser light-absorbers. The microcapsules can contain yellow, magenta and cyan dye, each of which is associated with an infrared-absorbing dye at a different wavelength. The microcapsules are randomly mixed together forming a single coated layer on the dye-donor support. These microcapsules can be individually addressed by three lasers, each having a wavelength tuned to the peak of the infrared-absorbing dye and each corresponding to a given color record.

However, there are a number of problems associated with the use of microcapsules in dye-donors. Microcapsules have cell walls that encapsulate ink and associated volatile ink solvents which are typically low-boiling oils or hydrocarbons that can be partially vaporized during printing and evaporate readily on the receiver as the ink dries. The use of volatile solvents can cause health and environmental concerns. In addition, solvent in the microcapsules can dry out over time before printing and therefore lead to changes in sensitivity (i.e., poor dye-donor shelf life). Further, since microcapsules are pressure-sensitive, if they are crushed, ink and solvent can leak out. Still further, microcapsule cell walls burst when printed, releasing ink in an all-or-nothing manner, making them poorly suited for continuous tone applications.

In U.S. Pat. No. 4,833,060, a method is disclosed for making polymeric particles by mixing an oil phase which contains organic components, under high shear conditions, in water with stabilizer and promoter to form an emulsion having a well-defined droplet size distribution. The solvent in the oil phase is then distilled off leaving the solid particles dispersed in water. There is no disclosure in this patent, however, of using this technique to make a dye-donor element for a laser-induced thermal dye transfer system.

It is an object of this invention to provide a multicolor dye-donor element for a laser-induced thermal dye transfer system which avoids the problems noted above with using microcapsules. It is another object of this invention to provide a multicolor dye-donor element whereby a multicolor transfer print can be obtained with only one pass through a laser print engine containing three lasers.

These and other objects are achieved in accordance with this invention which relates to a multicolor, multilayer dye donor element for laser-induced thermal dye transfer comprising a support having thereon two or more dye layers of different colors on top of each other, each dye layer comprising solid, homogeneous beads which contain an image dye, a binder and a laser light-absorbing material, the beads being dispersed in a vehicle, and the beads of each dye layer being sensitized to a different wavelength.

The beads which contain the image dye, binder and laser light-absorbing material can be made by the process disclosed in U.S. Pat. No. 4,833,060 discussed above, the disclosure of which is hereby incorporated by reference. The beads are described as being obtained by a technique called "evaporated limited coalescence."

The binders which may be employed in the solid, homogeneous beads of the invention which are mixed with the image dye and laser light-absorbing material include materials such as cellulose acetate propionate, cellulose acetate butyrate, polyvinyl butyral, nitrocellulose, poly(styrene-co-butyl acrylate), polycarbonates such as Bisphenol A polycarbonate, poly(styrene-co-vinylphenol) and polyesters. In a preferred embodiment of the invention, the binder in the beads is cellulose acetate propionate or nitrocellulose. While any amount of binder may be employed in the beads which is effective for the intended purpose, good results have been obtained using amounts of up to about 50% by weight based on the total weight of the bead.

The vehicle in which the beads are dispersed to form the dye layer of the invention includes water-compatible materials such as poly(vinyl alcohol), pullulan, polyvinylpyrrolidone, gelatin, xanthan gum, latex polymers and acrylic polymers. In a preferred embodiment of the invention, the vehicle used to disperse the beads is gelatin.

The beads are approximately 0.1 to about 20 μm in size, preferably about 1 μm. The beads can be employed at any concentration effective for the intended purpose. In general, the beads can be employed in a concentration of about 40 to about 90% by weight, based on the total coating weight of the bead-vehicle mixture.

Use of the invention provides a completely dry printing system that utilizes small, solid beads in multiple layers to print images having excellent print density at relatively high printing speed and low laser power. This system is also capable of printing different colors from a single pass since the different colored beads are individually addressed by two or more lasers each having a wavelength tuned near the peak of the laser light-absorbing dye, i.e., 780 nm for the laser light-absorbing dye in the cyan beads, 875 nm for the laser light-absorbing dye in the magenta beads and 980 nm for the laser light-absorbing dye in the yellow beads.

Monocolor dye donor elements are described in copending application Ser. No. 07/992,350 filed concurrently herewith and entitled "Dye-Containing Beads For Laser-Induced Thermal Dye Transfer". Since these elements contain beads of only one color, three passes in a print engine are needed with three different dye donors in order to make a multicolor image.

There are numerous advantages in making a multicolor image by printing with only one single pass dye-donor. Replacing two or more donors with only one donor results in less wasted support, fewer manufacturing steps, simpler finishing, simpler media handling in the printer, simpler quality assurance procedures and faster printing.

Multicolor elements are described in copending application Ser. No. 07/992,236 filed concurrently herewith and entitled "Mixture of Dye-Containing Beads For Laser-Induced Thermal Dye Transfer". These elements contain a mixture of beads having different colors in a single dye layer. While this element can be used to obtain good results in certain systems, it has been found that a multilayered structure of a dye-donor element has better color purity due to better thermal isolation of one color from another in the donor and better optical filtering of unwanted absorptions.

Spacer beads are normally employed in a laser-induced thermal dye transfer system to prevent sticking of the dye-donor to the receiver. By use of this invention however, spacer beads are not needed, which is an added benefit.

To obtain the laser-induced thermal dye transfer image employed in the invention, diode lasers are preferably employed since they offer substantial advantages in terms of small size, low cost, stability, reliability, ruggedness, and ease of modulation. In practice, before any laser can be used to heat a dye-donor element, the element must contain a laser light-absorbing material, such as carbon black or cyanine laser light-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained at a concentration of about 6 to about 25% by weight, based on the total weight of the bead. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser light-absorbing material is contained in the beads coated on the donor support.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the beads of the dye-donor employed in the invention provided it is transferable to the dye-receiving layer by the action of the laser. As noted above, beads of at least two different colors are employed in the multilayered dye-donor element of the invention in order to give a multicolor transfer. In a preferred embodiment, cyan, magenta and yellow dyes are used in the beads. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

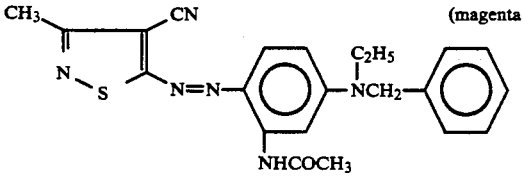

(magenta M-1)

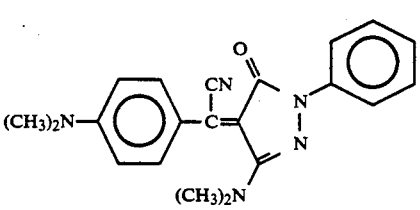

(magenta M-2)

-continued

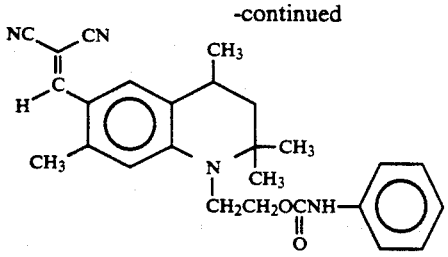

(yellow Y-1)

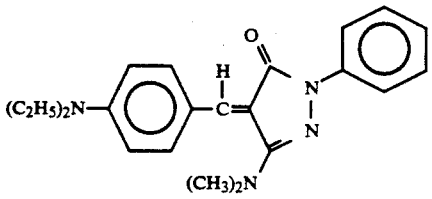

(yellow Y-2)

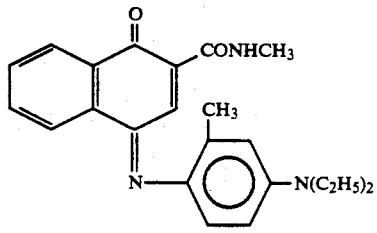

(cyan C-1)

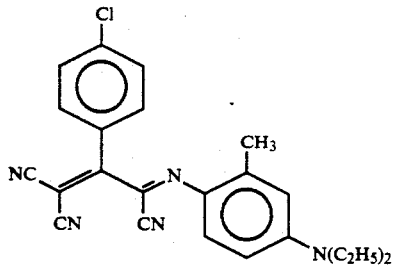

(cyan C-2)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The image dye may be employed in the bead in any amount effective for the intended purpose. In general, good results have been obtained at a concentration of about 40 to about 90% by weight, based on the total weight of the bead.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyester, cellulose esters, poly(styrene-co-acrylonitrile), polycaprolactone or mixtures thereof. The dye image-receiving layer may be present in any amount which is effective for the intended purpose. In general, good results have been obtained at a concentration of from about 1 to about 5 $g/m^2$.

A process of forming a multicolor laser-induced thermal dye transfer image according to the invention comprises:

a) contacting at least one multicolor, multilayer dye-donor element as described above, with a dye-receiving element comprising a support having thereon a polymeric dye image-receiving layer;
b) imagewise-heating the dye-donor element by means of a laser; and
c) transferring a dye image to the dye-receiving element to form the multicolor laser-induced thermal dye transfer image.

The following examples are provided to illustrate the invention.

PREPARATION OF BEAD DISPERSIONS

A combination of a polymeric binder as described below, image dye, and infrared dye was dissolved in dichloromethane (or methyl isopropyl ketone where indicated). A mixture of 30 ml of Ludox® $SiO_2$ (DuPont) and 3.3 ml of AMAE (a copolymer of methylaminoethanol and adipic acid) (Eastman Kodak Co.) was added to 1000 ml of phthalic acid buffer (pH 4). The organic and aqueous phases were mixed together under high shear conditions using a microfluidizer. The organic solvent was then distilled from the resulting emulsion by bubbling dry $N_2$ through the emulsion or by distillation using a rotavaporizer. This procedure resulted in an aqueous dispersion of solid beads in a water phase which was coarse-filtered followed by diafiltration, and the particles were isolated by centrifugation. The isolated wet particles were put into distilled water at a concentration of approximately 15 wt. %.

COATING PREPARATIONS PREPARATION OF THREE-LAYER TEST SAMPLES AND COMBINED COATINGS

Six magenta (M), yellow (Y), and cyan (C) bead dispersions, with and without incorporation of laser light-absorbing or infrared-absorbing dye (IR-1) (illustrated below) in the beads, were prepared according to the procedure outlined above. The structures of all dyes used are illustrated above. Cellulose acetate propionate (CAP=CAP 482-20 available from Tennessee Eastman Company) (2.5% acetyl and 45% propionyl) was used as binder. Table I summarizes the various combinations of materials used. Incorporation of the laser light-absorbing dye into a bead of a specific color is indicated by adding the term (IR) to the initial designating the bead color.

TABLE I

| Bead Dispersion | CAP (g) | IR-1 (g) | Dye (g) |
|---|---|---|---|
| D-1 M | 13 | — | M-1 (13) + M-2 (13) |
| D-2 M(IR-1) | 13 | 6 | M-1 (13) + M-2 (13) |
| D-3 Y | 13 | — | Y-1 (20.8) + Y-2 (5.2) |
| D-4 Y(IR-1) | 13 | 6 | Y-1 (20.8) + Y-2 (5.2) |
| D-5 C | 13 | — | C-1 (26) |
| D-6 C(IR-1) | 13 | 6 | C-1 (26) |

These dispersions were used to prepare three-layer test samples (odd-numbered E-#'s) in which magenta, yellow, and cyan-colored beads were applied in three separate layers, as well as to prepare combined single-layer coatings (even-numbered E-#'s) in which beads of each color were combined in one layer. The substrate used in all cases was a subbed 100 μm poly(ethylene terephthalate) support.

E-1 Three-layer C/M/Y(IR-1) test samples

The cyan coating used for the cyan layer was made by mixing 0.75 g gelatin (12.5%), 2.61 g of D-5 (7.2%), 0.46 g of a 10% solution of Dowfax 2A1 ® surfactant (Dow Chemical Company) and 16.18 g water. The magenta coating used for the magenta layer was made by mixing together 0.75 g gelatin (12.5%), 2.20 g of D-1 (8.54%), 0.46 g of a 10% solution of Dowfax 2A1 ® surfactant and 16.59 g water. The yellow coating used for the yellow dye layer was prepared from 0.75 g gelatin (12.5%), 1.39 g D-4 (13.5%), 0.46 g of a 10% solution of Dowfax 2A1 ® surfactant and 17.4 water. The cyan coating was applied first onto the substrate, followed by the magenta coating and finally the yellow coating.

E-2 C+M+Y(IR-1) combined single-layer coating

This coating contained 2.25 g gelatin (12.5%), 1.39 g D-4 (13.5%), 2.2 g D-1 (8.54%), 2.61 g D-5 (7.2%), 0.46 g of a 10% solution of Dowfax 2A1 ® surfactant and 11.29 g water.

The cyan coating was the same one used in E-1. The magenta coating was made from 0.75 g gelatin (12.5%), 1.81 g D-2 (10.4%), 0.46 g of a 10% solution of Dowfax 2A1 ® surfactant and 16.98 g water. The yellow coating was made from 0.75 g gelatin (12.5%), 2.19 g D-3 (8.6%), 0.46 g of a 10% solution of Dowfax 2A1 surfactant and 16.6 g water. The coatings were applied in the same order as in E-1.

E-4 C+M(IR-1)+Y combined single-layer coating

This coating contained 2.25 g gelatin (12.5%), 2.19 g D-3 (8.6%), 1.81 g D-2 (10.4%), 2.61 g of D-5 (7.2%), 0.46 g of a 10% solution of Dowfax 2A1 ® surfactant and 10.68 g water.

E-5 Three-layer C(IR-1)/M/Y test sample

The cyan coating was made from 0.75 g gelatin 912.5%), 1.22 g D-6 (15.45), 0.46 g of a 10% solution of Dowfax 2A1 ® surfactant and 17.57 g water. The magenta coating was the same as that of E-1. The yellow coating was the same as that of E-3. The coatings were applied in the same order as in E-1.

E-6 C(IR-1)+M+Y combined single-layer coating

This coating contained 2.25 g gelatin (12.5%), 2.19 g of D-3 (8.6%), 2.20 g of D-1 (8.54%), 1.22 g D-6 (15.4%), 0.46 g of a 10% solution of Dowfax 2A1 ® surfactant and 11.68 g water.

E-7 Three-layer C/M/Y(IR-1) test sample

The coatings used were the same as those of E-1. The yellow coating was applied first to the substrate, followed by the magenta coating and then the cyan coating.

E-8 C+M+Y(IR-1) combined single-layer coating

This coating contained 2.25 g gelatin (12.5%), 1.39 g D-4 (13.5%), 2.2 g D-1 (8.54%), 2.61 g D-4 (7.2%), 0.46 g of a 10% solution of Dowfax 2A1 ® surfactant and 11.09 g water.

E-9 Three-layer C/M(IR-1)/Y test sample

The coatings used were the same as those of E-3. The coatings were applied in the same order as in E-7.

E-10 C+M(IR-1)+Y combined single-layer coating

This coating contained 2.25 g gelatin (12.5%), 2.19 g D-3 (8.6%), 1.81 g D-2 (10.4%), 2.61 g D-5, 0.46 g of a 10% solution of Dowfax 2A1 ® surfactant and 10.68 g water.

E-11 Three-layer C(IR-1)/M/Y test sample

The coatings used were the same as those of E-5. The coatings were applied in the same order as in E-7.

E-12 C(IR-1)+M+Y combined single-layer coating

This coating contained 2.2 g gelatin (12.5%), 2.19 g D-3 (8.6%), 2.20 g D-1 (8.54%), 1.22 g D-6, 0.46 g of a 10% solution of Dowfax 2A1 ® surfactant and 11.68 g water.

E-13 Three-layer C/M(IR-1)/Y test sample

The coatings used were the same as E-3. The coatings were applied in the same order as E-1.

E-14 C+M(IR-1)+Y combined single-layer coating

This coating contained 2.25 g gelatin (12.5%), 2.19 g D-3 (8.6%), 3.62 g D-2 (10.4%), 5.22 g D-5 (7.2%), 0.46 g of a 10% solution of Dowfax 2A1 ® surfactant and 6.26 g water.

E-15 Three-layer C/M/Y(IR-1) test sample

The cyan coating was prepared from 0.75 g gelatin (12.5%), 5.22 g D-5 (7.2%), 0.46 g of a 10% solution of Dowfax 2A1 ® surfactant and 13.57 g water. The magenta coating was prepared from 0.75 gelatin (12.5%), 4.40 g D-1 (8.54%), 0.46 g of a 10% solution of Dowfax 2A1 ® surfactant and 14.39 g water. The yellow coating was prepared from 0.75 g gelatin (12.5%), 1.39 g D-4 (13.5%), 0.46 g of a 10% solution of Dowfax 2A1 ® surfactant and 17.4 g water. The coatings were applied in the same order as E-1.

E-16 C+M+Y(IR-1) combined single-layer coating

This coating contained 2.25 g gelatin (12.5%), D-4 (13.5%), 0.40 g D-1 (9.54%), 5.22 g D-5 (7.2%), 0.46 g of a 10% solution of Dowfax 2A1 ® surfactant and 6.26 g water.

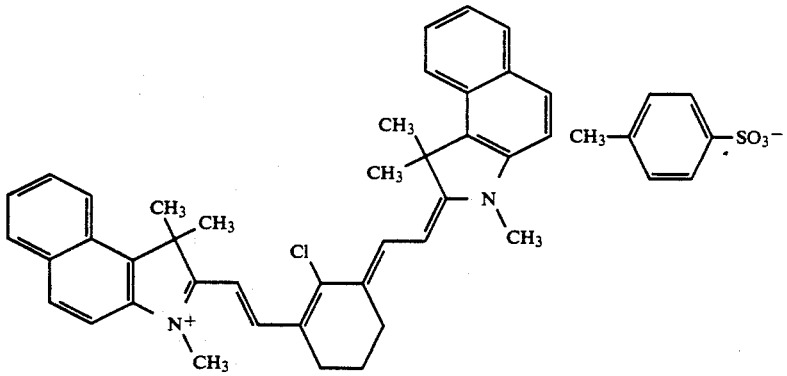

IR-Absorbing Dye IR-1

FLAT BED PRINT ENGINE

Experiments were conducted on a print engine utilizing a galvanic mirror to scan a Gaussian laser beam across a dye-donor/dye-receiver assembly, held on a flat bed with vacuum applied between the dye-donor and dye-receiver sheets. A Hitachi model HC8351E diode laser (rated at 50 mW, at 830 nm) was collimated and focussed to an elliptical spot on the dye-donor sheet approximately 13 μm (1/e2) in the page direction and 14 μm ($1/e^2$) in the fast scan direction. The galvanometer scan rate was typically 70 cm/sec and the measured maximum power at the dye-donor was 37 mW, corresponding to an exposure of approximately 0.5 $J/cm^2$. Power was varied from this maximum to a minimum value in 16 step patches of fixed power increments. Spacing between line scans in the page direction was typically 10 μm center-to-center corresponding to 1000 lines/cm or 2540 lines/in. Prints were made to either a resin-coated paper support or a transparent receiver and fused in acetone vapors at room temperature for 7 minutes. The transparent receiver was prepared from flat samples (1.5 mm thick) of Ektar® DA003 (Eastman Kodak), a mixture of bisphenol A polycarbonate and poly (1,4-cyclohexylene dimethylene terephthalate) (50:50 mole ratio).

THREE LASER PRINT ENGINE

In experiments where different IR laser wavelengths were required, the assemblage of dye-donor and dye-receiver was printed with a three laser lathe type printer having the characteristics indicated below. A drum, 41 cm in circumference was typically rotated at 150 rev/-min, corresponding to scan speeds of 103 cm/sec. Maximum power available at the dye-donor was 30 mW at 781 nm (from a Hitachi model HL-7851G diode laser), 30 mW at 875 nm (from a Sanyo model SDL-6033-101 diode laser) and 64 mW at 980 nm (from a Spectro Diode model SDL-6310-GI diode laser). The focussed elliptical laser spot sizes, as measured at the $1/e^2$ intensity along the primary axes, were approximately 10.0×10.4 μm at 781 nm, 11.2×10.4 μm at 875 nm, and 14.0×11.6 μm at 980 nm. The lasers can be controlled such that only one laser is on at a time or any combination is on simultaneously. In the experiment described below, and in Table V, the test prints were made with only one laser on at a time. The drum was translated in the page scan direction at 10 μm center-to-center line pitch corresponding to 1000 lines/cm or 2540 lines/in. A 16-step image was printed by varying the laser from maximum to minimum intensity in 16 equally spaced power intervals. Prints made to a resin-coated paper receiver were fused in acetone vapors at room temperature for 6 minutes.

SENSITOMETRY

Sensitometric data were obtained using a calibrated X-Rite 310 Photographic Densitometer (X-Rite Co., Grandville, Mich.) from printed step targets. Status A red, green and blue transmission densities were read from transparent receivers while status A red, green and blue reflection densities were read from paper receivers and indirect receivers laminated to paper.

RESULTS

Data comparing the wanted and unwanted Status A Reflection Densities from laser-induced thermal dye-transfer prints of combined single-layer and separate layer bead donors are shown in Table II. Reflection densities obtained using maximum laser power (37 mW) and 140 cm/s scan velocity are presented. "Wanted" absorptions, corresponding to the color of the bead sensitized to 830 nm, are underlined. Prints were made to resin-coated paper and fused for 7 minutes in acetone-saturated air at room temperature. Prints were made using the flat bead print engine with 633 nm or 30 nm laser light, as indicated.

TABLE II

Reflection Density from Prints Using Three-Color Donors at Two Wavelengths

| | 633 nm | | | 830 nm | | |
|---|---|---|---|---|---|---|
| Example | Red | Green | Blue | Red | Green | Blue |
| E-13 C/M(IR-1)/Y (separate layers) | 0.43 | 0.20 | 0.05 | 0.67 | 1.46 | 0.56 |
| E-14 C+M(IR-1)+Y (mixed together-control) | 0.65 | 0.40 | 0.14 | 0.95 | 1.34 | 0.48 |
| E-15 C/M/Y(IR-1) (separate layers) | 0.39 | 0.18 | 0.04 | 0.20 | 0.38 | 1.34 |
| E-16 C+M+Y(IR-1) (mixed together-control) | 0.31 | 0.22 | 0.07 | 0.53 | 0.37 | 0.89 |

The data in Table II clearly demonstrate that multicolor donors containing beads can produce different colors when exposed with different wavelengths. In E-13-16, the cyan image dye absorbs strongly at 633 nm. Therefore, the cyan image dye in these examples also functions as a laser light-absorbing material. E-14 prints cyan with 633 nm and magenta with 830 nm exposure. E-16 prints cyan with 633 nm and greenish-yellow with 830 nm. It is also clearly demonstrated that the degree of color contamination, or crosstalk, is much less for the layered structures E-13 and E-15 than for the mixed bead structures E-14 and E-16, respectively. (This is particularly evident when viewed as the ratio of wanted to unwanted absorption.)

Data comparing the Status A Reflection Densities obtained from dye-donors having different orders of the separate bead layers are shown in Table III along with a comparison with the mixed layer controls. In each example only one color is sensitized to 830 nm with IR-1 dye, as indicated. Reflection densities obtained using maximum laser power (37 mW) and 70 cm/s scan velocity are shown; the "wanted" absorption corresponding to the color of the sensitized bead is underlined. The first example in each group of four is coated in the order cyan, magenta, yellow (i.e., cyan closest to the support) as indicated. The second entry corresponds to a coating with the reverse order of laydown. The last two rows in each group correspond to replicate controls of mixed bead dye-donors. The ratio of unwanted (Status A) density to wanted density is shown in the last three columns.

TABLE III

| Example # | Reflection Density from Prints Using Three-Color Donors | | | | | |
|---|---|---|---|---|---|---|
| | STATUS A DENSITY[b] | | | UNWANTED/ WANTED[c] | | |
| Description[a] | Red | Green | Blue | Red | Green | Blue |
| E-1 C/M/Y(IR-1) | 0.40 | 0.64 | 1.88 | 0.21 | 0.34 | — |
| E-7 Y(IR-1)/M/C | 1.18 | 0.79 | 1.45 | 0.81 | 0.54 | — |
| E-2 C+M+Y(IR-1) | 1.20 | 0.93 | 1.74 | 0.69 | 0.53 | — |
| E-8 C+M+Y(IR-1) | 1.23 | 0.96 | 1.79 | 0.69 | 0.54 | — |
| E-3 C/M(IR-1)/Y | 0.78 | 1.47 | 0.90 | 0.53 | — | 0.61 |
| E-9 Y/M(IR-1)/C | 1.50 | 1.70 | 0.72 | 0.88 | — | 0.42 |
| E-4 C+M(IR-1)+Y | 1.28 | 1.75 | 0.90 | 0.73 | — | 0.51 |
| E-10 C+M(IR-1)+Y | 1.37 | 1.76 | 0.93 | 0.78 | — | 0.53 |
| E-5 C(IR-1)/M/Y | 1.29 | 0.67 | 0.52 | — | 0.52 | 0.40 |
| E-11 Y/M/C(IR-1) | 1.87 | 0.91 | 0.36 | — | 0.49 | 0.19 |
| E-6 C(IR-1)+M+Y | 1.75 | 0.98 | 0.69 | — | 0.56 | 0.39 |
| E-12 C(IR-1)+M+Y | 1.63 | 0.90 | 0.62 | — | 0.55 | 0.38 |

[a]+ implies randomly mixed; / implies layered (where colors to the left are coated below those on the right); IR-1 dye is incorporated in beads as indicated.
[b]Wanted densities from the IR-sensitized beads are underlined.
[c]Ratio of unwanted Status A Density divided by wanted Status A Density.

The data in Table III clearly demonstrate that the layer order is significant. General trends indicate that the beads closer to the free surface transfer dye with greater efficiency than do the beads below. It is significant, however, that the efficiency of dye transfer from beads in the lower layers is reduced by only a small fraction. These observations indicate that unwanted absorption can be controlled by placing the more efficient dye (i.e. dyes leading to the most objectionable visual color contamination) lowest in the stack. In the current set of examples, cyan contamination on yellow dye transfer is the most visually objectionable, resulting in a green appearance rather than a clean yellow. The problem is particularly evident in the examples of randomly mixed beads. The results in Table III confirm that placing cyan on the bottom and yellow on top produces the cleanest yellow transfers. With this arrangement yellows appear yellow through much of the tone scale, turning slightly brownish at the highest densities due to some magenta contamination. In contrast the arrangement with cyan on top is much worse and is no better than the mixed bead case for cyan contamination on yellow.

E17 Three-Layer C(IR-2)/M(IR-1)/Y(IR-3)

A cyan bead dispersion was prepared as in E-1 except that 6.0 g of IR-2 (S101756 from ICI Corp.) was employed. A magenta bead dispersion was prepared as in E-3. A yellow bead dispersion was prepared as in E-3, except that 6.0 g of IR-3 (Cyasorb® IR-165 from American Cyanamid Corp.) was added.

The cyan coating used for the cyan layer was made by mixing 1.28 g of the 32.7% solids cyan dispersion, 0.56 g gelatin (9.0%), 2.0 g of a 1% solution of Keltrol T® xanthan gum (Merck Co.), 0.93 g of a 10% solution of Dowfax 2A1® surfactant and 15.2 g of distilled water.

The magenta coating used for the magenta layer was made by mixing 1.49 g of the 19.2% solids magenta dispersion, 0.56 g gelatin (9.0%), 2.0 g of a 1% solution of Keltrol T® xanthan gum (Merck Co.), 0.93 g of a 10% solution of Dowfax 2A1® surfactant and 15.0 g of distilled water.

The yellow coating used for the yellow layer was made by mixing 0.77 g of the 24.4% solids yellow dispersion, 1.0 g of a 1% solution of Keltrol T® xanthan gum (Merck Co.), 0.93 g of a 10% solution of Dowfax 2A1® surfactant and 17.3 g of distilled water. The coatings were applied as in E-1.

The results obtained for Status A red, green and blue density, from the D-max step using the three laser printer at 781 nm, 875 nm and 980 nm, respectively, are summarized in Table V.

TABLE V

| | 781 nm | | | 875 nm | | | 980 nm | | |
|---|---|---|---|---|---|---|---|---|---|
| Ex. | R | G | B | R | G | B | R | G | B |
| 17 | 0.63 | 0.50 | 0.34 | 0.09 | 0.21 | 0.16 | 0.00 | 0.03 | 0.37 |

The above data show that a single dye-donor with three dye layers can be sensitized to three different IR wavelengths and can be selectively addressed to print different colors. With the 781 nm laser, the dye-donor printed a blue-gray color. With the 875 nm laser, a red-purple color was obtained. With the 980 nm laser, a pure yellow color was achieved. The lack of color saturation in this example is due primarily to the unwanted absorption of the IR dye set and the relatively close spacing of the three diode wavelengths and is not a fundamental limitation. Narrower absorption band IR dyes or more widely separated diode laser wavelengths would ameliorate this color saturation problem.

The invention has been described in detail with particular reference to preferred embodiments thereof, but it will be understood that variations and modifications can be effected within the spirit and scope of the invention.

What is claimed is:

1. A multicolor, multilayer dye donor element for laser-induced thermal dye transfer comprising a support having thereon two or more dye layers of different colors on top of each other, each dye layer comprising solid, homogeneous beads which contain an image dye, a binder and a laser light-absorbing material, said beads being dispersed in a vehicle, and said beads of each said dye layer being sensitized to a different wavelength.

2. The element of claim 1 wherein said vehicle is gelatin.

3. The element of claim 1 wherein said binder is cellulose acetate propionate or nitrocellulose.

4. The element of claim 1 wherein said beads are approximately 0.1 to about 20 μm in size.

5. The element of claim 1 wherein said beads are employed at a concentration of about 40 to about 90% by weight, based on the total coating weight of the bead-vehicle mixture.

6. The element of claim 1 wherein each said laser light-absorbing material is a dye.

7. A process of forming a multicolor laser-induced thermal dye transfer image comprising:

a) contacting a multicolor, multilayer dye donor element comprising a support having thereon two or more dye layers of different colors on top of each other, each dye layer comprising solid, homogeneous beads which contain an image dye, a binder and a laser light-absorbing material, said beads being dispersed in a vehicle, and said beads of each said dye layer being sensitized to a different wavelength, with a dye-receiving element comprising a support having thereon a polymeric dye image-receiving layer;

b) imagewise-heating said dye-donor element by means of a laser; and c) transferring a dye image to said dye-receiving element to form said multicolor laser-induced thermal dye transfer image.

8. The process of claim 7 wherein said vehicle is gelatin.

9. The process of claim 7 wherein said binder is cellulose acetate propionate or nitrocellulose.

10. The process of claim 7 wherein said beads are approximately 0.1 to about 20 μm in size.

11. The process of claim 7 wherein said beads are employed at a concentration of about 40 to about 90% by weight, based on the total coating weight of the bead-vehicle mixture.

12. The process of claim 7 wherein each said laser light-absorbing material is a dye.

13. A thermal dye transfer assemblage comprising:

(a) a multicolor, multilayer dye donor element for laser-induced thermal dye transfer comprising a support having thereon two or more dye layers of different colors on top of each other, each dye layer comprising solid, homogeneous beads which contain an image dye, a binder and a laser light-absorbing material, said beads being dispersed in a vehicle, and said beads of each said dye layer being sensitized to a different wavelength, and (b) a dye-receiving element comprising a support having thereon a dye image-receiving layer, said dye-receiving element being in superposed relationship with said dye-donor element so that said dye layer is in contact with said dye image-receiving 14. The assemblage of claim 13 wherein said vehicle is gelatin.

15. The assemblage of claim 13 wherein said binder is cellulose acetate propionate or nitrocellulose.

16. The assemblage of claim 13 wherein said beads are approximately 0.1 to about 20 μm in size.

17. The assemblage of claim 13 wherein said beads are employed at a concentration of about 40 to about 90% by weight, based on the total coating weight of the bead-vehicle mixture.

18. The assemblage of claim 13 wherein each said laser light-absorbing material is a dye.

* * * * *

UNITED STATES PATENT AND TRADEMARK OFFICE

CERTIFICATE OF CORRECTION

PATENT NO. : 5,234,890

DATED : August 10, 1993

INVENTOR(S) : Mitchell S. Burberry, John M. Noonan, Thomas A. Machell and Danny R. Thompson It is certified that error appears in the above-indentified patent and that said Letters Patent is hereby corrected as shown below:

Column 14, lines 23-24, "image-receiving" should read --image-receiving layer --.

Signed and Sealed this

Twenty-second Day of March, 1994

*Attest:*

*Attesting Officer*

BRUCE LEHMAN

*Commissioner of Patents and Trademarks*